United States Patent [19]

Heider et al.

[11] Patent Number: 4,782,266

[45] Date of Patent: Nov. 1, 1988

[54] RAPID-START SINGLE-ENDED HIGH-PRESSURE DISCHARGE LAMP

[75] Inventors: Jürgen Heider; Richard Kotschenreuther, both of Munich; Wolfgang Schade, Kirchheim, all of Fed. Rep. of Germany

[73] Assignee: Patent Treuhand Gesellschaft für elektrische Glühlampen mbH, Munich, Fed. Rep. of Germany

[21] Appl. No.: 913,322

[22] Filed: Sep. 30, 1986

[30] Foreign Application Priority Data

Oct. 24, 1985 [DE] Fed. Rep. of Germany ..... 3537872

[51] Int. Cl.[4] ..... H01J 61/04

[52] U.S. Cl. ..... 313/631; 313/620; 313/621

[58] Field of Search ..... 313/631, 620, 621, 641, 313/642, 623

[56] References Cited

U.S. PATENT DOCUMENTS

| | | | |
|---|---|---|---|
| 4,320,322 | 3/1982 | Rothwell, Jr. et al. | 313/621 |
| 4,321,504 | 3/1982 | Keeffe et al. | 313/620 |
| 4,386,292 | 5/1983 | Rothwell et al. | 313/113 X |
| 4,454,450 | 6/1984 | English et al. | 313/621 X |
| 4,631,446 | 12/1986 | English et al. | 313/634 |

*Primary Examiner*—David K. Moore
*Assistant Examiner*—Michael Horabik
*Attorney, Agent, or Firm*—Frishauf, Holtz, Goodman & Woodward

[57] ABSTRACT

To provide for a long electrode shaft, which insures rapid and reliable starting of the lamp, the electrodes are formed with a straight shaft portion extending from a pinch or press seal (8) and then twisted into a loop (20, 21) which terminates in discharge tips (18, 19), facing each other across the center line of the lamp. The loops, preferably, include a circular portion of about 270°, with a radius of greater than the radius of the diameter of the wires—typically of tungsten—and offset with respect to the electrode shaft so that, at cross-over points (24, 25) the looped portion (20, 21) of the respective electrode and the straight or shaft portion (22, 23) of the electrode do not touch each other; a very small spacing, for example 0.05 mm, with electrode wires of 0.2 mm diameter, is sufficient. The electrodes can be identical, so that, in facing positions, the loops will be on opposite sides with respect to a plane passing through the center of the lamp, and the electrodes, then, can be twisted by an angle in the order of about 30°, or somewhat less, e.g. 27°, so that the electrode wire tips will be in-line (L) with respect to each other to reliably and continuously throughout the lift of the lamp define the discharge zone in a predetermined relation or position with respect to the remainder of the lamp so that, upon inclusion in an optical system (e.g. a reflector) (R), the light emitting zone will, reliably, remain constant in relation to the optical system.

13 Claims, 3 Drawing Sheets

RAPID-START SINGLE-ENDED HIGH-PRESSURE DISCHARGE LAMP

The present invention relates to a single-ended or single-based high-pressure discharge lamp of quartz glass in which an arc tube or discharge tube retains a fill of mercury, metal halides and a noble gas, and which has two electrodes with points directed towards each other between which a discharge will occur.

BACKGROUND

A discharge lamp of the general type to which the present invention relates is described in U.S. Pat. No. 4,415,829. This lamp is intended to be used with direct current operation, and has a power rating of less than 100 W. to insure that the discharge arc will start at the cathode tip, a winding or twist is located close to the end point of the electrode forming the cathode.

Single-based or single-ended discharge lamps of this type are sometimes difficult to start rapidly and reliably when cold; after having been operated for some time, and when the lamp is hot, re-starting may be even more difficult. Slow or difficult starting, resulting apparently from poor transfer of the arc on the electrode, also interferes, in due course, with light output since the discharge vessel or arc tube or arc vessel will become blackened.

It appears that the poor transfer of the arc to the tips of the electrodes may be due to slow heating of the electrodes to operating temperature. Such electrodes frequently have substantial thermal losses. The heating time of the electrodes is proportional to the square of the radius of the electrode wire, and inversely proportional to the length of the electrodes and to the current passing through the lamp. The electrode wires—typically of circular cross section—cannot be dimensioned at random; if one starts, for example, form a fixed radius of the electrode wire and a predetermined fixed operating current of the lamp, decreasing the heating time can be obtained only by increasing the length of the electrode. This, however, then interferes with a desired miniaturization of the lamp.

German Patent Disclosure Document DE-OS No. 32 42 840 describes an electrode which is formed of a straight shaft portion, close to the path or press seal, and a second portion formed in wound or coil form close to the discharge end, in which the coils of windings are so arranged that adjacent windings of the coil portion do not touch each other. In such an electrode, the discharge arc can start at any place at the last winding, facing the discharge region, of the coiled portion. This, then, results in formation of the discharge arc within the discharge vessel at a random position. Consequently, such a lamp cannot be used when intended for combination with an optical system where the discharge must be placed, accurately, at a focal point or other predetermined defined point with respect to a reflector or to a lensetic system, for short in an optical system, where the position of the arc must be predetermined.

THE INVENTION

It is an object to provide a single-ended high-pressure discharge lamp which has rapid and reliable ignition and which, additionally, is suitable for combination with an optical system, for example as a projection lamp, as a search light, or other light beam generator.

Briefly, the arc lamp has the usual discharge vessel, which is single-ended or single-based, for example by conducting current from connection terminals via molybdenum foils to the electrodes themselves. In accordance with a feature of the invention, the electrodes are formed as electrode wires, for example of circular cross section, which first extend straight into the discharge vessel and then, adjacent the discharge tips of the electrodes, are formed in a loop which, in plan view, appears closed, and hence defines, with the straight portion of the electrode shaft, a cross-over point. The loop extends from the straight portion of the electrode shaft and is directed away from the discharge zone between the electrode tips. The loop is offset with respect to the thickness of the wire so that, at the cross-over, the respective looping wires do not touch each other. The loop, then, is extended in a direction transverse to the direction of the shaft—as it comes from the single-ended press, to face the axis of the lamp, and hence, the electrode tip of the opposite electrode which can be formed in the same way.

The discharge of the arc in the lamp, thus, will cross the axis of symmetry of the discharge vessel and the point or position of the discharge within the lamp will be predetermined by the tips of the electrodes which face each other.

In a simple form, the electrodes for the lamp can be made by shaping the loop in form of an eye which, essentially, is located in a plane defined by the discharge zone between the two electrodes and the electrode shafts. Essentially, this will mean that any point of the loop will have an angle of at most $\pm 30°$ with a plane formed by the electrode shafts and the discharge. If the entire loop would be in that plane, the crossing wire portions would have to be connected at the crossover point which, however, would detract from increase of the effective length of the electrode.

The loop or eye, preferably, should be so shaped that it is essentially circular over about at least 180° and the tip of the electrodes should have an angle with respect to the electrode shaft of about 90°. The radius of the circular portion of the loop which, for example, can be inscribed within the loop, should be at least the radius of the electrode wire.

The electrode has the advantage of simple and inexpensive manufacture while eliminating a thermal short circuit along the length of the electrode wire. The electrode wire is made of high-temperature resistant material which may well be rather brittle. The loop, thus, should be so made that the brittleness or stiffness of the wire will not cause fissures to occur in the looped portion; the wires should not have any creases or sharp bends which might form a starting point for corrosion. Such corrosion is particularly dangerous if tin-sodium halides are present in the fill.

The difference between the distance of the two electrode shafts and the distance of the facing electrode points should be at least twice the diameter of the electrode wires. This insures that—over the entire lifetime of the lamp—the defined point of the arc will always occur at the tip of the electrodes, even though, in operation, the electrode tip may burn off. The position of the arc in the lamp, thus, will not change throughout its life, and its predetermined position with respect to an external optical system is likewise retained.

DRAWINGS

DETAILED DESCRIPTION

Figure 1:
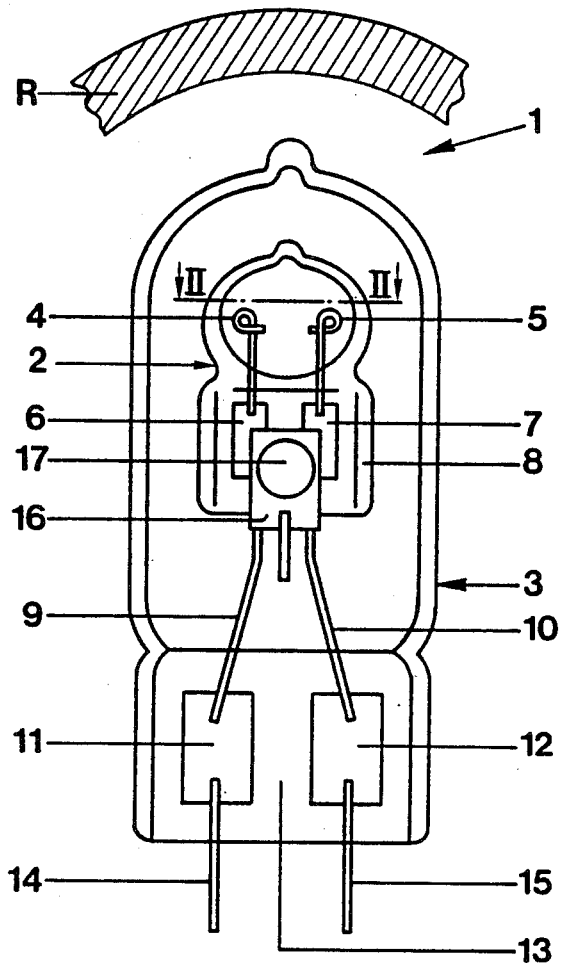
FIG. 1 is a side view of the lamp within a surrounding bulb.

The lamp 1—see FIG. 1—is intended for association with an optical system shown schematically and in fragmentary form only as a reflector R. The reflector R may, of course, be essentially bowl-shaped, and extend behind the lamp, shown in side view in FIG. 1. Of course, other types of optical systems may be used, such as, for example, condenser lenses and the like, located in a plane parallel to the plane of the drawing of FIG. 1, to receive light from the lamp generated by an arc between the facing tips of the electrodes 4, 5.

The lamp 1 itself is made of a single-ended or single-based discharge vessel 2 of quartz glass. The discharge vessel 2 is surrounded by a single-ended bulb 3, likewise formed with a pinch seal. The electrodes 4, 5 shown only schematically, are electrically connected by molybdenum foils 6, 7 within the press or pinch seal 8 of the discharge vessel 2 and, in turn, connected to lead wires 9, 10 which, in turn, are electrically connected by molybdenum foils 11, 12 to the terminal pins 14, 15 of the lamp. The molybdenum foils 11, 12 and the connecting portions of the wires 9, 10 and 14, 15, respectively, are retained within a pinch or press seal 13 of the outer bulb 3. A base connection for the lamp, for example for insertion into a suitable matching terminal, has been omitted from the drawing for clarity and may be formed in accordance with any well known and standard construction. The press seal or pinch seal 8 of the discharge vessel 2 likewise retains a metal plate 16 on which a zirconium getter 17 is secured.

The arc vessel or discharge vessel 2 has a fill of mercury, a noble gas and metal iodides or bromides of sodium, tin, thallium, indium and lithium. A lamp having a power rating of 40 W provides light of about 75 lm/W.

Figure 2:
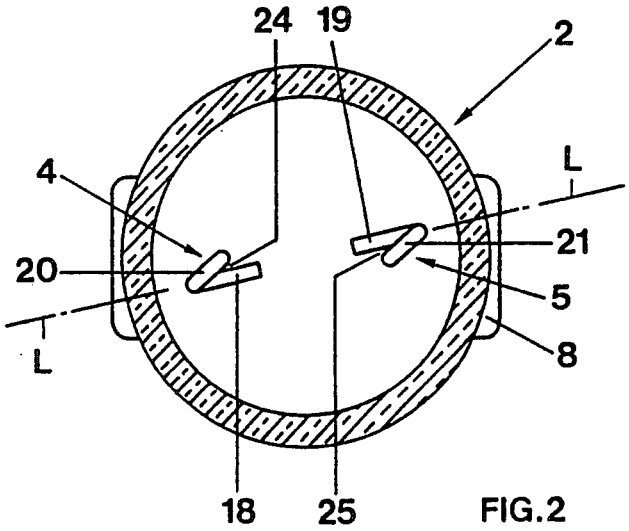
FIG. 2 is a sectional view along line II—II of FIG. 1, omitting the outer bulb and the elements of the lamp within the press seal.
Figure 3:
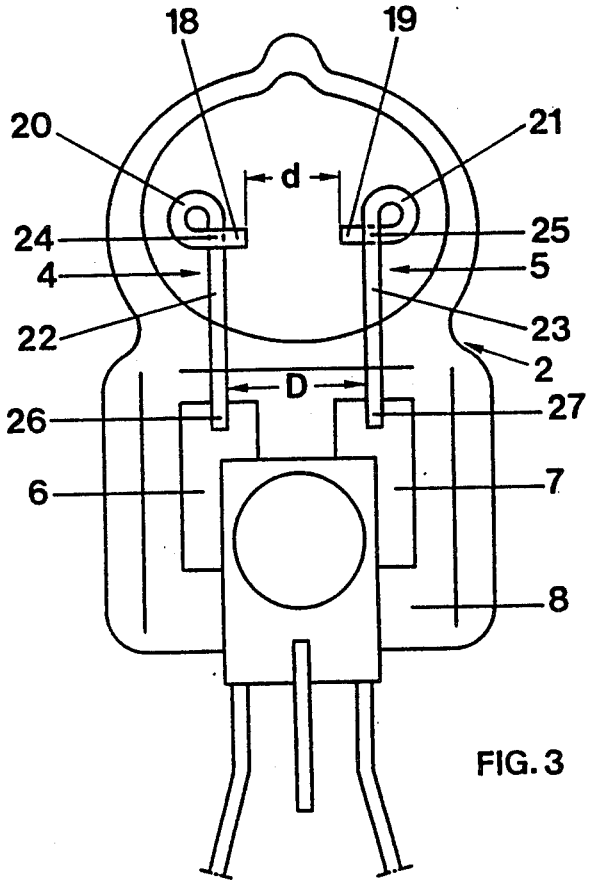
FIG. 3 is an enlarged side view of the discharge vessel or arc tube of the lamp.

FIGS. 2 and 3 illustrate the discharge vessel 2 in an enlarged representation, and, particularly, the electrodes 4 and 5. The electrodes 4, 5 are made of tungsten wire of about 0.2 mm thickness, of circular cross section, and adjacent the tips of the electrodes 18, 19 are wound into a loop having a circular portion extending over about 270°. The loops 20, 21 of the electrode wires define the shape of an eye. The arc or loop portions 20, 21 are positioned on the side of the shafts 22, 23 of the electrodes 4, 5 remote from the center line or line of symmetry of the lamp, and hence remote from the discharge. The inner diameter of the circular portion of the eyes 20, 21 is about 0.3 mm. The tips 18, 19 of the electrodes form an angle of 90° with the shafts 22, 23. The tips extend beyond the closest mutual approach of the shafts by preferably at least the diameter of the wires, and, desirably, somewhat more than the diameter of the wires, towards each other from the cross-over points 24, 25 with the shafts—in the example illustrated about 0.3 mm beyond the cross-over points 24, 25. At the cross-over points 24, 25, the wire portions forming the shafts 22, 23, and the wire portions forming the loops 20, 21, and extending toward the tips 18, 19, are spaced from each other by a distance of about 0.05 mm. Thus, the wire portions do not touch each other at the cross-over point of the loops. The shafts 22, 23 extend from the cross-over points (24, 25) to the respective molybdenum sealing strips 6, 7 in the press 7 by a distance of about 7 mm.

The loops 20, 21 in the electrodes are preferably so made that the electrode wire for the respective electrodes 4, 5 is drawn over the electrode shaft 22, 23 at the same side so that, when positioned opposite each other, the loops will be at opposite sides of the shaft portion of the electrodes—see FIG. 2. This is not a necessary feature, but simplifies manufacture, since it is then necessary to make only one bending die or fixture to bend the electrode wires, and it is not necessary to separately stock "right" and "left" electrodes. Before forming the press seal 8 of the discharge vessel, the electrode shafts 22, 23 are rotated with respect to each other by about 27° so that the tips 18, 19 of the electrodes extend in an essentially continuous straight line—see FIG. 2—and point towards the direction of the discharge arc. This direction line L of the tips is shown in FIG. 2 in fragmentary form only outside of the region of the electrodes for clarity.

In a preferred form, the difference (D−d) of the spacing (D) of the electrode shafts (22, 23) and the spacing (d) of the electrode tips (18, 19) from each other is at least twice the diameter of the electrode wires (4, 5).

We claim:

1. Rapid-heating, arc-position-stabilized, single-ended high-pressure discharge lamp (1) having a transparent discharge vessel (2) of high-temperature resistant glass;

a single press or pinch seal (8) at one end thereof;

a fill of mercury and additions of metal halides and a noble gas within the disclosure vessel; and two wire electrodes (4, 5) of high-temperature resistant material having discharge tips (18, 19) pointing towards the axis of the lamp and towards each other, sealed through the single press seal, wherein, in accordance with the invention, each of the wire electrodes is lengthened by formation into a creaseless loop (20, 21) curving away from the lamp axis and adjacent the discharge tips (18, 19) which loops, in plan view, appear closed and hence each define, with a respective straight or shaft portion (22, 23) of the electrode wire extending from the pinch or press seal, a cross-over point (24, 25), the discharge tips (18, 19) of the electrodes forming axial ends, of said respective loops, remote from said shaft portions, and extending toward each other beyond the closest mutual approach of said straight or shaft portions (22, 23), thereby assuring consistent striking of the arc on the tips and stable positioning of the arc, and the loop of the wire extending and smoothly curving from the straight or shaft portion (22, 23) of the electrode shaft in a direction away from a discharge zone between the electrode tips (18, 19), and being offset with respect to the thickness of the wire to effect crossing of the respective looping wires over the straight or shaft portions without touching at the cross-over points (24, 25).

2. The lamp of claim 1, wherein the loops (20, 21) are positioned essentially in a plane defined by the electrode shaft or straight portion (22, 23) and a theorectical line (L) connecting the tips (18, 19) of the electrodes between which said discharge zone is defined.

3. The lamp of claim 1, wherein the loops (20, 21) define a part-circular portion extending over at least 180°;

and wherein the tips (18, 19) form straight wire portions extending from the loop, and forming an angle with the straight or shaft portions (22, 23) of the electrodes of about 90°.

4. The lamp of claim 3, wherein the radius of the part-circular portion, which can be inscribed within the circular portion of the loop (20, 21), is at least the radius of the wire forming the electrodes.

5. The lamp of claim 1, wherein the difference (D−d) of the spacing (D) of the electrode shafts (22, 23) and the spacing (d) of the electrode tips (18, 19) from each other is at least twice the diameter of the electrode wires.

6. The lamp of claim 1, wherein the electrodes (4, 5) are formed by wires of essentially circular cross section;

and wherein the difference (D−d) of the spacing (D) of the electrode shafts (22, 23) and the spacing (d) of the electrode tips (18, 19) from each other is at least twice the diameter of the electrode wires.

7. The lamp of claim 1, wherein the electrodes (4,5) are formed of wires of essentially circular cross section;

wherein the loops (20, 21) define a part-circular portion extending over at least 180°;

wherein the tips (18, 19) form straight wire portions extending from the loop, and forming an angle with the straight or shaft portions (22, 23) of the electrodes of about 90°;

and wherein the radius of the circular region of the loop which can be inscribed corresponds at least to the radius of the electrode wire.

8. The lamp of claim 7, wherein the radius of the circular portion of the loop (20, 21) is greater than the radius of the wire.

9. The lamp of claim 9, wherein the radius of the loop (20, 21) is about 1.5 times the radius of the wire.

10. The high-pressure discharge lamp (1)

as claimed in claim 1 further comprising an optical system (R)

wherein the lamp (1) is positioned in predetermined relationship with respect to the optical system to define a predetermined position of the discharge zone between the electrode tips (18, 19) with respect to said optical system (R).

11. The high pressure discharge lamp (1)

as claimed in claim 3 further comprising an optical system (R)

wherein the lamp (1) is positioned in a predetermined relationship with respect to the optical system (R) to define a predetermined position of the discharge zone between the electrode tips (18, 19) with respect to said optical system;

and wherein the difference (D−d) of the spacing (D) of the electrode shafts (22, 23) and the spacing (d) of the electrode tips (18, 19) from each other is at least twice the diameter of the electrode wires.

12. The combination of claim 11, wherein the wire electrodes (4, 5) within the discharge vessel are identical, and are twisted with respect to each other by an angle in the order of approximately 30° to place the portions of the electrode wires adjacent the tips (18, 19) in essentially a straight line (L) and define the discharge zone between the electrode tips essentially in-line with the adjacent portions of the electrode wires while permitting placement of the cross-over points in non-touching position with respect to the straight or shaft portions (22, 23) of the electrodes.

13. The lamp of claim 1, wherein the wire electrodes (4, 5) within the discharge vessel are identical, and are twisted with respect to each other by an angle in the order of approximately 30° to place the portions of the electrode wires adjacent the tips (18, 19) in essentially a straight line (L) and define the discharge zone between the electrode tips essentially in-line with the adjacent portions of the electrode wires while permitting placement of the cross-over points in non-touching position with respect to the straight or shaft portions (22, 23) of the electrodes.

* * * * *

UNITED STATES PATENT AND TRADEMARK OFFICE

CERTIFICATE OF CORRECTION

PATENT NO. : 4,782,266

DATED : November 1, 1988

INVENTOR(S) : Heider et al

It is certified that error appears in the above-identified patent and that said Letters Patent is hereby corrected as shown below:

On the Title Page,
In the Abstract, line 22, "lift" should read --life--.

Column 5, claim 9, line 40, "...of claim 9" should read

--...of claim 8--.

Signed and Sealed this

Nineteenth Day of September, 1989

*Attest:*

DONALD J. QUIGG

*Attesting Officer*

*Commissioner of Patents and Trademarks*